United States Patent [19]

Linder et al.

[11] 4,428,195

[45] Jan. 31, 1984

[54] ROTARY VACUUM PUMP

[75] Inventors: Ernst Linder, Mühlacker; Helmut Rembold, Stuttgart; Walter Teegen, Waiblingen, all of Fed. Rep. of Germany

[73] Assignee: Robert Bosch GmbH, Stuttgart, Fed. Rep. of Germany

[21] Appl. No.: 256,465

[22] Filed: Apr. 22, 1981

[30] Foreign Application Priority Data

Apr. 22, 1980 [DE] Fed. Rep. of Germany ..... 3015409

[51] Int. Cl.[3] ..... F04C 29/08; F02B 67/00

[52] U.S. Cl. ..... 60/397; 60/428; 418/17; 418/23; 418/151; 418/223; 418/238; 418/266

[58] Field of Search ..... 60/396, 428, 456, DIG. 3, 60/397; 91/46; 418/151, 266, 223, 238, 17, 23

[56] References Cited

U.S. PATENT DOCUMENTS

| | | | |
|---|---|---|---|
| 1,538,075 | 5/1925 | Wingquist | 418/151 |
| 2,526,621 | 10/1950 | Leibing et al. | 418/151 |
| 2,863,286 | 12/1958 | Doane | 60/428 |
| 3,954,358 | 5/1976 | Normandin | 418/151 |
| 4,024,709 | 5/1977 | Erdmann | 60/430 |
| 4,229,147 | 10/1980 | Linder et al. | 418/23 |

FOREIGN PATENT DOCUMENTS

| | | | |
|---|---|---|---|
| 2808208 | 2/1976 | Fed. Rep. of Germany . | |
| 1233386 | 5/1971 | United Kingdom | 60/DIG. 3 |

*Primary Examiner*—Robert E. Garrett
*Assistant Examiner*—Richard S. Meyer
*Attorney, Agent, or Firm*—Edwin E. Greigg

[57] ABSTRACT

A rotary vacuum pump is proposed, having a rotor with vanes which rotates eccentrically within a housing bore. Each vane is coupled with a body which is ineffective at relatively low pump rpm; however, at higher rpm, the body engages the vane in such a manner that it removes the vane from its track within the housing bore.

In this manner, an rpm-dependent shutoff device is created for the pump. In cooperation with the furnishing of underpressure as an auxiliary pressure in motor vehicles, the pump is used to supplement the underpressure which prevails when the internal combustion engine is at low, idling rpm; this prevailing underpressure is at a very low pressure level, and so when it is thus supplemented there is sufficient auxiliary vacuum force available over the entire rpm range.

6 Claims, 3 Drawing Figures

ROTARY VACUUM PUMP

BACKGROUND OF THE INVENTION

The invention is directed to improvements in a vacuum pump rotor, at least one vane separating an inlet and an outlet, and switch-off means. A vacuum pump of this type is known (German Offenlegungsschrift No. 28 08 208). In this known design, each vane is fully removable from its track within the housing bore, so that all friction is avoided, as well as impact noises. However, this pump necessitates the use of a specialized actuation device, substantially comprising a work-performing cylinder, and it is not always possible to mount an actuation device of this kind on the pump, particularly when space is restricted.

OBJECTS AND SUMMARY OF THE INVENTION

The principal object of the rotary positive-displacement pump disclosed and claimed herein is that it is not necessary to mount a specialized actuation device on the pump from the outside. The actuation device is designed such that it can be integrated into the rotor directly behind each vane, so that it "disappears" entirely within the rotor.

A further object of the invention is to provide small dimensions to such a device, so that it is very favorable in cost and not very likely to malfunction.

Another object of the invention is that it does not require any particular line connection, such as would be necessary for connecting a pneumatic or hydraulic line in a known actuation device.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
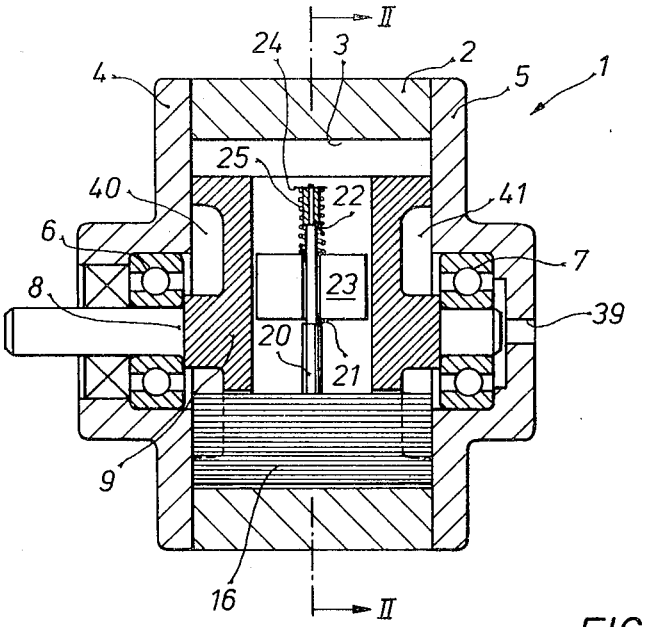
FIG. 1 is a cross section taken through an exemplary embodiment of the pump according to the invention.

Referring firstly to FIG. 1, there is shown a rotary vacuum pump 1 having a housing 2 with a housing bore 3. The housing 2 and the housing bore 3 are sealed laterally by two caps 4 and 5, in each of which one ball bearing 6, 7 is secured. The two ball bearings 6 and 7 are arranged to receive a shaft 8, driven via a tang (not shown), which supports a rotor 9.

Figure 2:
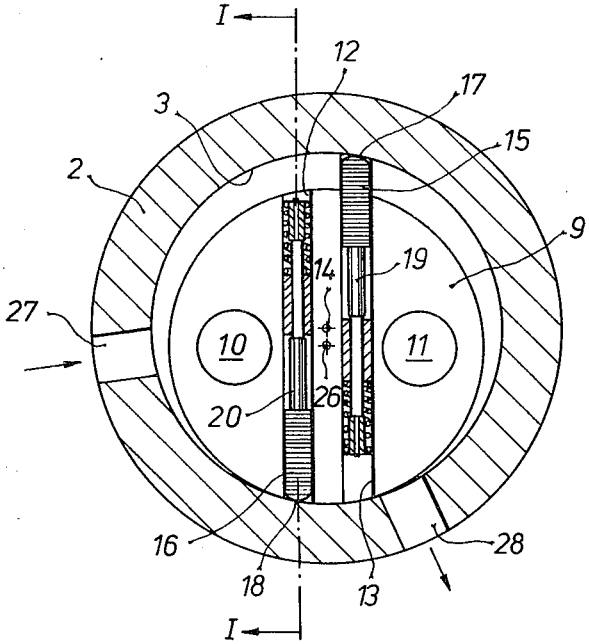
FIG. 2 is a lateral, sectional view of the pump taken through line II—II of FIG. 1.

As FIG. 2 shows, the rotor 9 is supported eccentrically relative to the housing bore 3. The rotor 9 is lightened by two weight-reducing bores 10 and 11 and provided with two slots 12 and 13. The slots 12 and 13 extend parallel to one another and are disposed at either side of the center point 14 of the rotor 9. A vane 15, 16 is provided within each slot 12 and 13, respectively; the vanes 15 and 16 terminate outwardly in rounded end faces 17 and 18, respectively; the rounded end faces allow the vanes to slide along the wall of the housing bore 3. A shaft 19, 20 is inserted from the rear into vanes 15 and 16, respectively with their inserted end fixedly secured to their respective vane, and the shafts are provided with respective stops 21 and 22. Between the stops 21 and 22, there is disposed for movement along shafts 19 and 20, a counter-weight 23 whose axial extent is smaller than the distance between the stops 21 and 22. On the end remote from the vane 15 or 16, each shaft 19, 20 is provided with a terminal disc 24 against which a spring 25 is supported on one end, while at the other end the spring rests on the counter-weight 23 tending to hold the counter-weight 23 firmly against the stop 21 spaced from the vane 16 (or 15, respectively). The stops 21 and 22 are disposed such that the stop 21 is located in the vicinity of a shaft center point 26, and the stop 22 is spaced apart from the stop 21 by a distance which is approximately equal to the length of the counter-weight 23 plus 5 mm.

It should further be noted that an intake bore 27 and an outlet bore 28 are provided in the pump housing 2.

MODE OF OPERATION

When the pump 1 is operating slowly, the counter-weight 23 continues to rest on the stop 21, under the force of the spring 25. The two vanes 15 and 16, with their oppositely-disposed end faces 17 and 18, contact the wall of the housing bore 3 and act as revolving partitions, so as to generate a vacuum.

However, if the rotational speed of the pump is increased, to 1200 rpm, for instance, then the centrifugal force exerted upon the counter-weight 23 is so great that the force of the spring 25 is overcome, and the counter-weight 23 moves against the stop 22 thereby exerting a force on the stop 22 which is counter to the vanes 15 and 16 such that the force on shafts 19 and 20 will be in a direction away from the vanes. Since the shafts 19 and 20 are fixed to the vanes the vanes will be moved in the direction of movement of the counter-weights 23.

Because of this shift of mass, the vanes 15 and 16 automatically disengage contact with the wall within the housing 2 and retreat into the rotor 9, whereupon the pump ceases to function. If the driving rpm is then reduced once again, then the force of the spring 25 once again overcomes the inertial mass of the counter-weight 23, with the result that the counter-weight returns to the position resting against the stop 21 which permits the vanes 15 and 16 to return to their normal position against the bore 3. Below a rotational speed of 1000 rpm, for example, the vanes 15 and 16 once again assume their working position, and the pump 1 then resumes its operation.

One advantageous application of a pump of this kind is in vacuum braking devices. In Otto cycle engines, the vacuum present in the intake tube, which is conventionally used in order to provide servo braking force, is so small, in the idling rpm range, that it is too weak to suffice as an amplification force for braking purposes. It is accordingly necessary, in the lower rpm range of such an engine, to generate supplementary vacuum using a specialized pump. Above the idling rpm range, the auxiliary pump can be switched off, because the vacuum then generated in the intake tube by the engine does suffice to provide the required amplification force.

Figure 3:
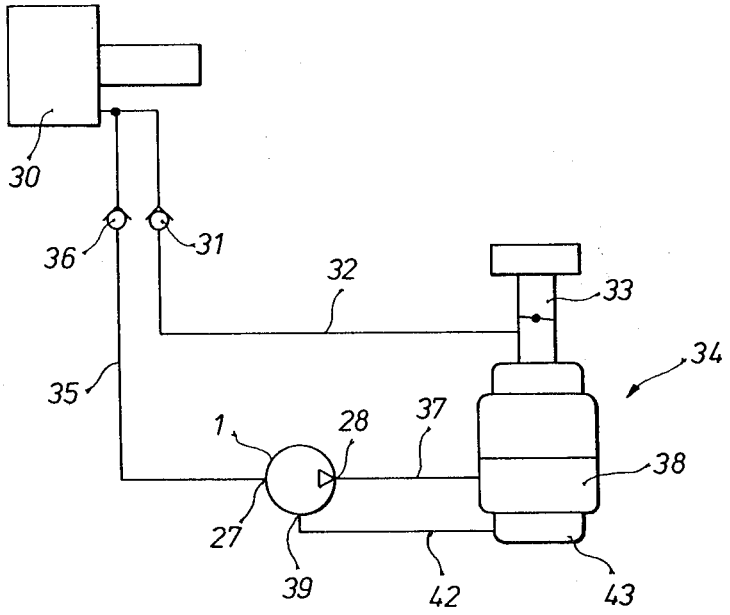
FIG. 3 is a schematic diagram of a vacuum-servo device for a brake force amplifier.

The pump according to the invention is schematically shown in FIG. 3 integrated into a vacuum-servo braking system. A vacuum brake force amplifier 30 is connected, primarily via a check valve 31 and a line 32, with an intake tube 33 of an internal combustion engine 34. An additional line 35 leads via a check valve 36 to the pump 1, specifically to its intake connection 27. The shaft 8 of pump 1 can be driven by any known means such as by the engine of the vehicle in which it is used, by a separate electric motor or via a belt drive for the accessories of the vehicle such as the power steering, generator, or power brakes. The pump outlet bore 28 is connected via a line 37 to a crankcase 38 of the engine 34.

It should also be noted that the pump 1 has an oil connection 39 by means of which chambers 40 and 41 shown in FIG. 1, located in lateral opposed flat faces of the rotor 9, are connected via a line 42 to an oil pan 43 of the engine 34. When the pump 1 is operating, approximately half the vacuum prevails in the chambers 40 and 41. This pressure drop is sufficient to aspirate lubricating oil from the oil pan 43 into the pump 1, where it lubricates areas of friction and the bearings. After the vanes have been retracted, the equalization of pressure causes the delivery of oil to cease automatically.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. A rotary pump for producing vacuum having a housing provided with a bore, a rotor arranged to rotate eccentrically within said bore, at least one vane provided on said rotor, an inlet and an outlet communicating with said rotor and separated by said at least one vane, and means applying a counter-force on said at least one vane for switching off pump vacuum, characterized in that said rotor includes at least one slot disposed on either side of a center point of said rotor, in which said at least one vane is mounted, a shaft secured to each said at least one vane and extending into said at least one slot, said shaft including first and second stops thereon, said means for applying a counter force relative to said at least one vane mounted in said at least one slot for sliding movement between said first and second stops relative to said shaft, said means comprises a counter-weight, said counter-weight being arranged to assume a first position at idle rpm and a second position at higher rpm, each said at least one vane having an end engaging said bore in said first position, of said counter-weight, said counter-weight acting to disengage the end of each said at least one vane from engaging said bore when in said second position of said counter-weight, whereby at higher rpm said pump ceases producing vacuum.

2. A rotary pump as defined by claim 1, further characterized in that each said at least one vane has an extremity opposite said ends on which a shaft is provided, said counter-weight being slidably mounted on the shafts beween said two stops.

3. A rotary pump as defined by claim 2, further characterized in that a spring acts on said counter-weight in said first position to normally force said counter-weight against said first stop on said shaft.

4. A rotary pump as defined by claim 1, further characterized in that two slots are provided in parallel through said rotor, with one vane, for each slot each said slot having two opposite extremities adjacent said bore, one extremity provided with one vane, with the opposite extremity provided with said counterweight, with said counter-weight normally near the center of said slot.

5. In a vacuum-servo braking system for a gasoline engine, a rotary pump for generating a supplementary vacuum in an idling rpm range of the engine, the rotary pump comprising: a housing provided with a bore, a rotor arranged to rotate eccentrically within said housing, two vanes provided on said rotor within separate slots on said rotor, an inlet and an outlet communicating with said rotor and separated by said vanes, a counter-weight mounted within said slot and movable relative to each said vane, said counter-weight being arranged to assume a first position in said idling rpm range and a second position at an arbitrarily set higher rpm each of said vanes having an end engaging said bore in said first position of said counter-weight, said counter-weight acting to disengage the ends of said vanes from said bore in said second position of said counter-weight whereby at said higher rpm said pump ceases producing said supplementary vacuum.

6. The combination, in a vacuum-servo braking system for a gasoline engine in a motor vehicle, of a vacuum-brake force amplifier, an intake tube, a first line provided with a check valve connected between said amplifier and said intake tube of said engine, a rotary pump, a second line provided with a check valve connected between said amplifier and said rotary pump, a third line connected between said rotary pump and a crankcase of said engine, and a fourth line connecting an oil pan of said engine with said rotary pump, said rotary pump comprising a housing provided with a bore, a rotor arranged to rotate eccentrically within said housing, two vanes provided on said rotor within separate slots on said rotor, an inlet and an outlet communicating with said rotor and separated by said vanes, a counter-weight mounted within said slot and movable relative to each vane, said counter-weight being arranged to assume a first position in said idling rpm range and a second position at an arbitrarily set higher rpm, each of said vanes having an end engaging said bore in said first position of said counter-weight, said counter-weight acting to disengage the ends of said vanes from said bore in said second position of said counter-weight, whereby at said higher rpm said pump ceases producing said supplementary vacuum.

* * * * *